US007779571B1

(12) United States Patent
Roth

(10) Patent No.: US 7,779,571 B1
(45) Date of Patent: Aug. 24, 2010

(54) AUTO LOADER FIREARM ACCESSORY

(76) Inventor: Mark Roth, W8057 Greystone Ct., Appleton, WI (US) 54915

( * ) Notice: Subject to any disclaimer, the term of this patent is extended or adjusted under 35 U.S.C. 154(b) by 337 days.

(21) Appl. No.: 12/150,665

(22) Filed: Apr. 29, 2008

Related U.S. Application Data

(60) Provisional application No. 60/926,991, filed on Apr. 30, 2007.

(51) Int. Cl.
*F41A 9/00* (2006.01)

(52) U.S. Cl. ..... 42/17; 42/19; 42/49.01

(58) Field of Classification Search ..... 42/87, 42/19, 6, 49.01, 67, 88, 89, 106, 17; 89/33.17, 89/33.5, 33.03
See application file for complete search history.

(56) References Cited

U.S. PATENT DOCUMENTS

| | | | | | |
|---|---|---|---|---|---|
| 580,679 | A * | 4/1897 | Davenport | 42/21 |
| 618,369 | A * | 1/1899 | Wilson | 42/49.01 |
| 1,420,471 | A * | 6/1922 | Carter | 42/19 |
| 2,420,471 | A | 6/1922 | Carter | |
| 2,237,291 | A * | 4/1941 | Carter | 42/19 |
| 3,399,481 | A | 9/1968 | Giorgini | |
| 4,207,797 | A * | 6/1980 | Gyorik | 42/6 |
| 4,905,395 | A | 3/1990 | Wagner | |
| 5,054,221 | A | 10/1991 | Ozols | |
| 5,119,575 | A | 6/1992 | Gajdica | |
| 6,418,833 | B1 | 7/2002 | Hajjar | |
| 6,865,840 | B2 | 3/2005 | Kanyuck et al. | |
| 6,877,265 | B2 | 4/2005 | Hajjar et al. | |
| 7,275,342 | B2 * | 10/2007 | Medvedeo | 42/19 |
| 7,380,361 | B2 * | 6/2008 | Hajjar et al. | 42/19 |
| 2004/0020093 | A1 * | 2/2004 | Hajjar et al. | 42/49.01 |
| 2005/0241204 | A1 * | 11/2005 | Hajjar et al. | 42/19 |
| 2007/0119085 | A1 * | 5/2007 | Mautone Medvedeo | 42/19 |
| 2008/0121096 | A1 * | 5/2008 | Hajjar et al. | 89/33.1 |

* cited by examiner

*Primary Examiner*—Michael Carone
*Assistant Examiner*—Jonathan C Weber
(74) *Attorney, Agent, or Firm*—Brannen Law Office, LLC

(57) ABSTRACT

The present invention can have an adjustable length adapter that attaches to the firearm, and in one embodiment directly to an existing load tube. A mounting assembly and an indexing assembly are further provided. The mounting assembly has a mounting plate with an alignment hole for allowing a shell to pass there through from an aligned tube and into the adapter. The indexing assembly indexes relative the mounting assembly to successively align one of a plurality of tubes with the alignment hole. As one tube fills, the invention can be rotated to index the next tube and tension a rotator that can be positioned generally parallel to the firearm barrel. This process can be repeated until all four tubes are full. Upon emptying of a tube, a pin can be automatically activated to allow the indexing assembly to rotate relative the mounting assembly to align the next successive tube.

14 Claims, 12 Drawing Sheets

AUTO LOADER FIREARM ACCESSORY

This utility patent application claims priority on and the benefit of provisional application 60/926,991 filed Apr. 30, 2007, the entire contents of which are hereby incorporated herein by reference.

BACKGROUND OF THE INVENTION

1. Field of the Invention

The present invention relates to an auto loader firearm accessory, and in particular to a multiple tube magazine extension that is removably attached to a variety of existing firearms including those with shotgun tube magazines.

2. Description of the Related Art

It is desirable in some applications to be able to fire more rounds than what can be presently contained in standard firearms including shotguns. For instance, military, police and competitive sport shooters may desire a shotgun capable of firing many rounds before the need to reload. Many attempts have been made over the years to satisfactorily fill this need. Some examples follow.

U.S. Pat. No. (hereafter "USPN") 6,877,265 to Hajjar et al. is entitled System and Method for Increased Magazine Capacity for a Firearm. This patent shows an actuator 33 in FIG. 8. The actuator is taught to be operably connected to a trigger assembly. A magazine is disclosed having a plurality of tubes axisymmetric about a longitudinal axis. A retainer 6 in FIGS. 2 and 4*a* is shown for impeding release of a cartridge from an open end of a tube.

U.S. Pat. No. 6,865,840 to Kanyuck et al. is entitled Gun Loading Device. This patent shows a loading device for use with muzzle loaded firearms. A plunger is shown for sequentially pushing charges of powder in the bores through a discharge opening in the base member.

U.S. Pat. No. 5,119,575 to Gajdica is entitled Rotary Magazine for Firearms. This patent discloses a rotary feed magazine for a pump action shotgun. The magazine has chambers that can be rotated into alignment with the receiver chamber. The magazine is taught to replace the conventional pump action.

U.S. Pat. No. 5,054,221 to Ozols is entitled Shotgun with Interchangeable Magazine. This patent shows an interchangeable magazine with a cylindrical tubular portion for receiving shotgun shells. The magazine is removably attached to the shotgun. A mounting member is coupled to a closed end of the magazine. A rod portion is received through an aperture through the closed end of the magazine to facilitate mounting of the magazine to the shotgun.

U.S. Pat. No. 4,905,395 to Wagner is entitled Increased Capacity Magazine for Firearm. This patent shows a housing. A rotating mechanism including tubes is taught to be within the housing. The housing has a center tubular housing, a forward housing and a rear housing. The rear housing has an opening in alignment with the loading port of the shotgun. The patent shows an indexing mechanism for indexing each shell tube, and has a rotation latch pivotally mounted to the rear housing. A follower automatically releases the rotation latch to allow a revolving mechanism to advance the next shell tube when a shell tube is empty.

U.S. Pat. No. 3,399,481 to Giorgini is entitled Detachable Charger for Automatic Shotguns. This patent discloses its main purpose is for providing a detachable and exchangeable charger permitting use of chargers loaded with cartridges of different types and power. The detachable charger is taught to be received within or inserted into the fixed tube on the gun.

U.S. Pat. No. 1,420,471 to Carter is entitled Multimagazine Self Locking Rifle. This patent teaches that the ordinary magazine is dispensed with and the invention is used instead. Looking at FIG. 7 of the patent, a non rotating plate 19' is shown. The plate is provided with rearwardly extending spaced ears 21, which embrace sides of the breech tube 6. The plate 19' has a cartridge receiving opening 24 which aligns with the openings in the breech tube so as to permit the cartridges to be fed into the tube.

None of these patents show an accessory that is removably connectable to the end of a standard shotgun tube magazine.

None of these patents show an adapter that allows for a single design to be utilized with many existing shotguns without making permanent alterations to the shotgun. Specifically, none of these references show an adapter with an adjustable length.

None of these references show a pin projectable and retractably in a direction generally parallel to the longitudinal axis of the firearm barrel.

Thus there exists a need for an auto loader firearm accessory that solves these and other problems.

SUMMARY OF THE INVENTION

The present invention relates to an auto loader for a firearm, such as a shotgun 10 as seen in FIGS. 1 and 2. Shotguns 10 have a barrel 11 with a longitudinal axis 12, a stock 13, a firing mechanism 14 and a magazine load tube 15 with opposed ends 16 and 17. A cap (not shown) is at the second end 17 of the load tube 15. Removal of the cap exposes external threads 18 at the second end of the tube. The tube 15 generally has an interior 19 and an exterior 20.

The present invention can have an adjustable length adapter that attaches to the firearm and in one embodiment directly to the threaded end of the load tube. A mounting assembly and an indexing assembly are further provided. A mounting plate having an alignment hole can be provided in the mounting assembly for allowing a shell to pass there through and into the adapter. The indexing assembly indexes relative the mounting assembly to successively align one of a plurality of tubes with the alignment hole to allow shells to advance into the shotgun magazine tube or directly into the firearm.

As one tube fills, the invention can be rotated to index to the next tube and tension a rotator that can be positioned generally parallel to the firearm barrel. This process can be repeated until all four tubes are full. Upon emptying of a tube, a pin can be automatically activated to allow the indexing assembly to rotate relative the mounting assembly to align the next successive tube.

Advantageously, the present invention is useful to increase the capacity of a shotgun. In a preferred embodiment, the capacity can increase from 5 rounds up to over 20 rounds.

Further, the present invention is installable onto a variety of existing firearms. In particular, the present invention connects to shotguns of standard design. This can be accomplished by mating the adapter with the end of the existing tube magazine, or alternatively by replacing the tube magazine with the present invention.

Still further, the installation of the present invention is accomplished without making any permanent modifications to the firearm, and installation is quick and easy.

Still further yet, the adapter of the present invention has an adjustable length. This is advantageous as it maintains proper spacing of the projectiles to allow the indexing assembly to properly rotate relative the mounting assembly.

Still further yet, the present invention has an indexing assembly to decrease the total linear length of the shell assembly required for the increased shell capacity.

Still further yet, the mounting assembly has a pin that is operable along an axis that is generally parallel to the longitudinal axis of a barrel. This is advantageous as the pin is at little risk of being inadvertently engaged or damaged during operation and the profile of the present invention may be minimized.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
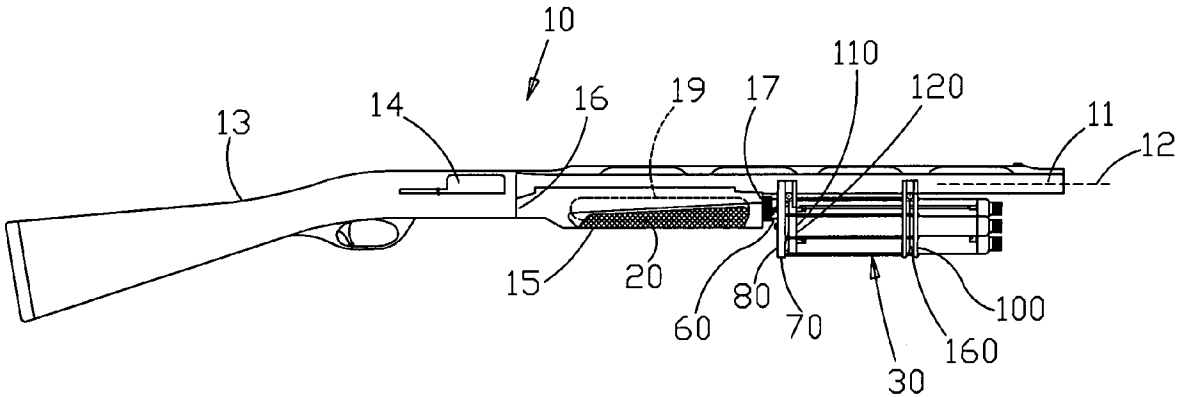
FIG. 1 is a side view of a firearm with an embodiment of the present invention attached.
Figure 2:
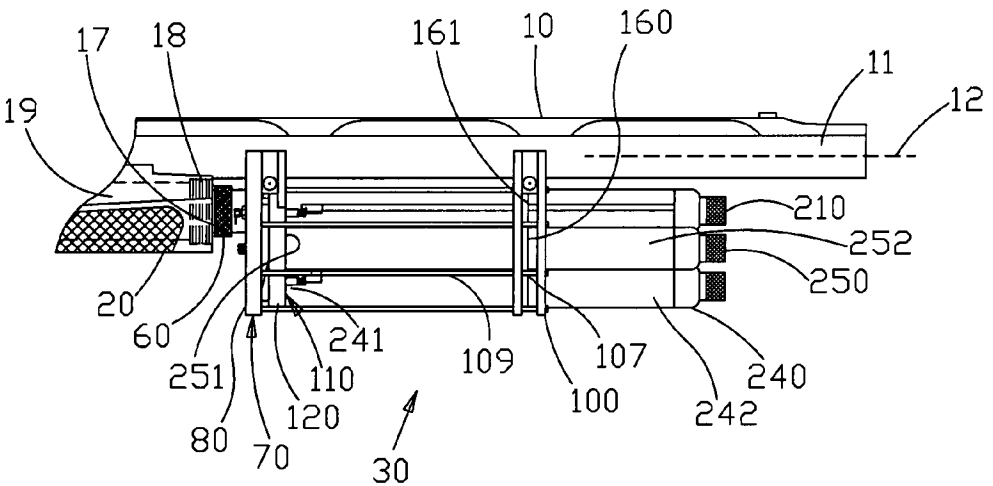
FIG. 2 is close up side view of a firearm with an embodiment of the present invention attached.

While the invention will be described in connection with several preferred embodiments, it will be understood that it is not intended to limit the invention to those embodiments. On the contrary, it is intended to cover all alternatives, modifications and equivalents as may be included within the spirit and scope of the invention as defined by the appended claims.

The present invention is described for use in combination with shells 5, having ends 6 and 7. The structure of shells 5 shown and described is illustrative only and not intended to be limiting. Rather, it is appreciated that other objects or projectiles can also be used without departing from the broad aspects of the present invention.

Further, it is appreciated that other types of projecting devices, such as electric, magnetic, electro-magnetic, or alternative chemical projecting devices can be adapted for use with the broad aspects of the present invention. For illustrative purposes only, a standard shotgun is illustrated. Further, the magazine tube 15 of the standard shotgun 10 can be removed and the adapter (described below) can be affixed directly to the firearm.

A first embodiment of the present invention is illustrated in FIGS. 1-18. It is appreciated that the present invention is constructed of strong and light weight materials, such as carbon fiber or aluminum. It is well understood that other materials may be used without departing from the broad aspects of the present invention.

In the first preferred embodiment, the present invention 30 has an adapter 60, a mounting assembly 70 and an index assembly 110. Four tubes 180, 210, 240 and 250 are provided for being selectably and alternately aligned in a selected position. Each of these components, and the uses thereof, are herein described in detail.

Figure 5:
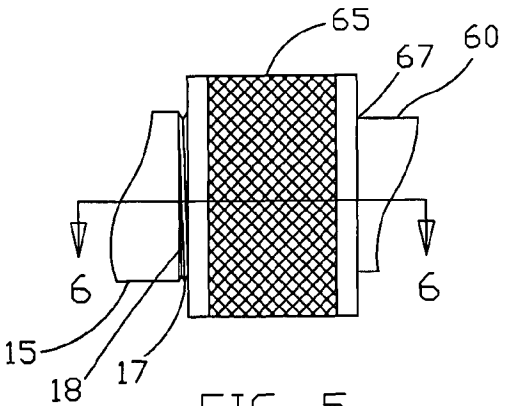
FIG. 5 is a close up view of an embodiment of the adapter of the present invention.
Figure 6:
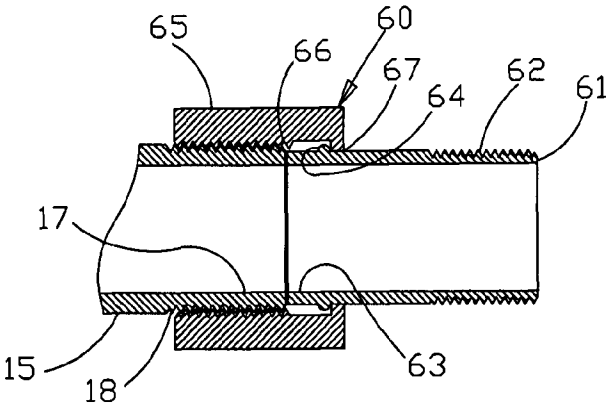
FIG. 6 is cross-sectional view taken along line 6-6 in FIG. 5.

Looking now to FIGS. 5 and 6 in particular, it is seen that an adapter 60 is illustrated. The adapter 60 has a first end 61 that is threaded with threads 62, and an opposed second end 63. A flange 64 is provided radially upon the exterior of the adapter 60. A nut 65 with threads 66 and an opening 67 is further provided. The nut 65 can mate with the threads on the end of a standard load tube 15 of a shotgun 10. It is appreciated that the nut 65 can also mate directly with the firearm if the load tube 15 is removed. The opening 67 has a diameter slightly larger than the outside diameter of the adapter 60, to allow the nut to move relative the adapter. The nut 65 can engage the flange 64 to hold the adapter in position. The nut 65 can be threaded into and out of the threads 18 on the load tube 15 to vary to overall effective length of the adapter 60. In the preferred embodiment, the adapter can be adjusted approximately ⅜ of an inch. While not shown specifically in the drawings, it is appreciated that the adapter 60 can have a flared end to accommodate the use of greater flexibility of different types of load cartridges. The adapter 60 is preferably designed for use with a specific firearm. Yet, by simply replacing the adapter 60, the remainder of the present invention 30 can be used in its present form with any number of alternative firearms.

Figure 17:
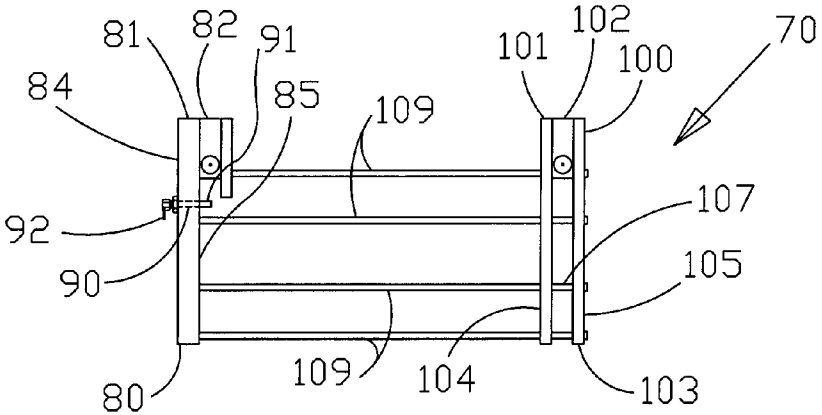
FIG. 17 is a side view of one embodiment of the mounting assembly of the present invention.

Looking now to FIG. 17 it is seen that a mounting assembly 70 is provided. The mounting assembly 70 is comprised of a first mount 80, or mounting plate, a second mount 100, or mounting plate, and several frame members 109. The mounting assembly 70 is preferably mounted to the barrel of the firearm. The mounting assembly 70 has a longitudinal axis between its free end and connected end that is generally parallel to the longitudinal axis 12 of the barrel of the firearm 10.

Turning now to FIGS. 2-4, 12 and 13, the first mount 80 is illustrated in detail. The first mount 80 had a top 81 with a clamp 82, and a bottom 83. The mount 80 further has a first side 84 and an opposed second side 85. A central hole 86 is through the mount 80. The hole 86 is preferably threaded with threads 87. A shell hole 88 is also provided. As used herein, the shell hole 88 is also referred to as the alignment hole. The shell hole 88 is preferably threaded with threads 89. The adapter 60 end 61 is preferably removably mated to the shell hole 88. A third hole 90 is also provided. The hole 90 has a pin 91 that projects or extends there through, and has a latch 92 at one end of the pin 91. The pin 91 is biased to extend a selected distance out from the second side 85 of the mount 80. One preferred biasing mechanism is a spring. Yet it is understood that other means of biasing may be employed without departing from the broad aspects of the present invention. The pin 91 may be temporarily retracted from the second side 85 of the mount upon a force being applied longitudinally to the pin. In the assembled preferred embodiment, the force required to retract the pin 91 is preferably directed along a line generally parallel to the longitudinal axis of the barrel. 11.

Figure 14:
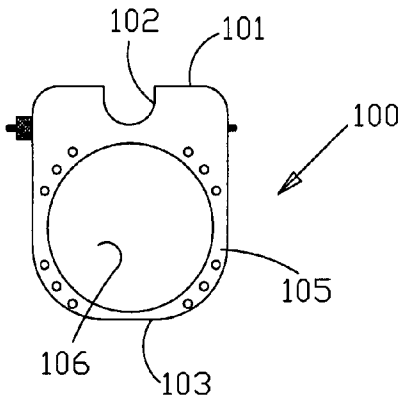
FIG. 14 is an isolation side view of one embodiment of the second mounting plate.
Figure 16:
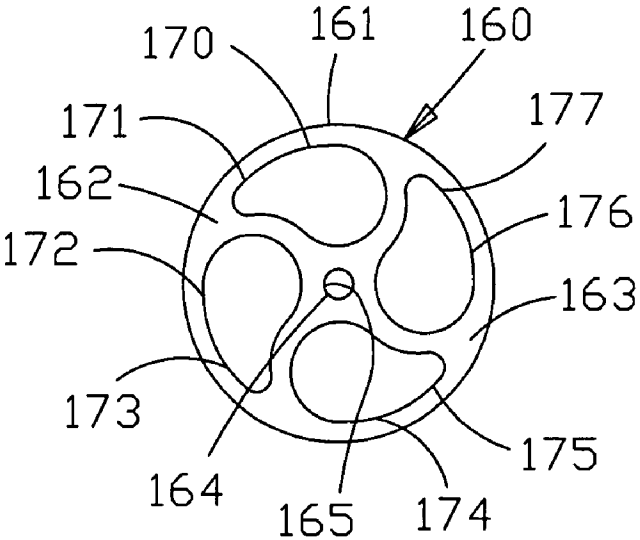
FIG. 16 is an isolation side view of one embodiment of the second indexing plate.

Now looking at FIGS. 14 and 17 in particular, the second mount 100 is illustrated. The second mount 100, or mounting plates, has a top 101. A clamp 102 is at the top of the mount 100. The mount 100 also has a bottom 103. The mount 100 can have two plates 104 and 105 that sandwich the clamp 102. A central hole 106 is provided. Several bearings 107 can be around the perimeter of the hole 106. The hole 106 is preferably concentric with central hole 86 of the first mount 80.

Several frame members 109 connect the first mount 80 with the second mount 100 to provide structural support. The mounting assembly 70 is preferably clamped to the barrel in an alignment wherein the central axis of the mounting assembly is generally parallel to the central axis of the barrel. The clamps 82 and 102 are preferably self centering clamps. The top of the barrel 11 is unobstructed by the clamps.

Figure 18:
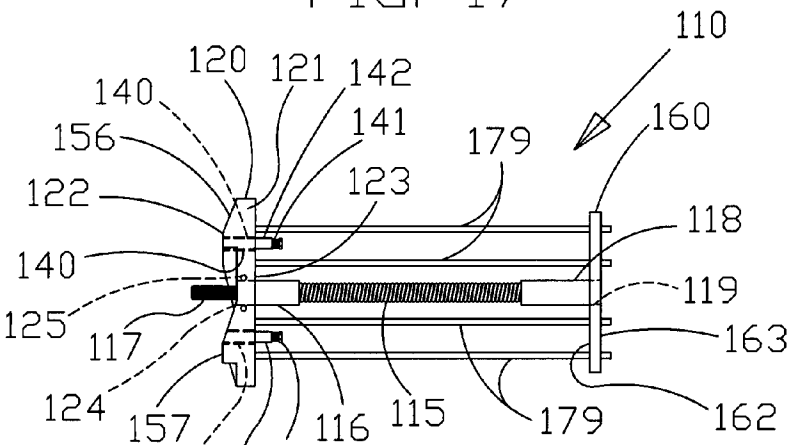
FIG. 18 is a side view of one embodiment of the indexing assembly of the present invention.
Figure 19:
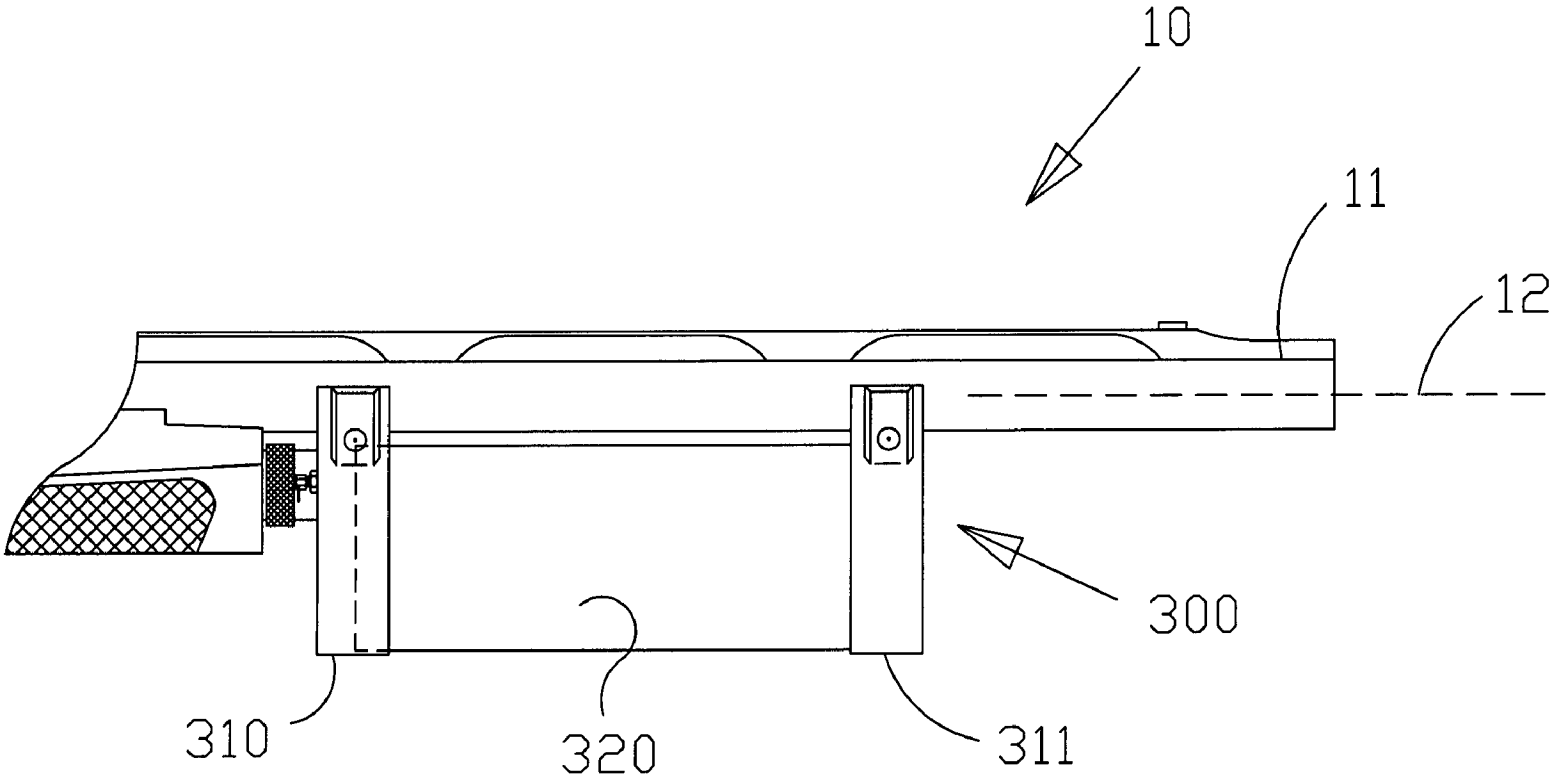
FIG. 19 is a side view of an alternative embodiment of the present invention.
Figure 21:
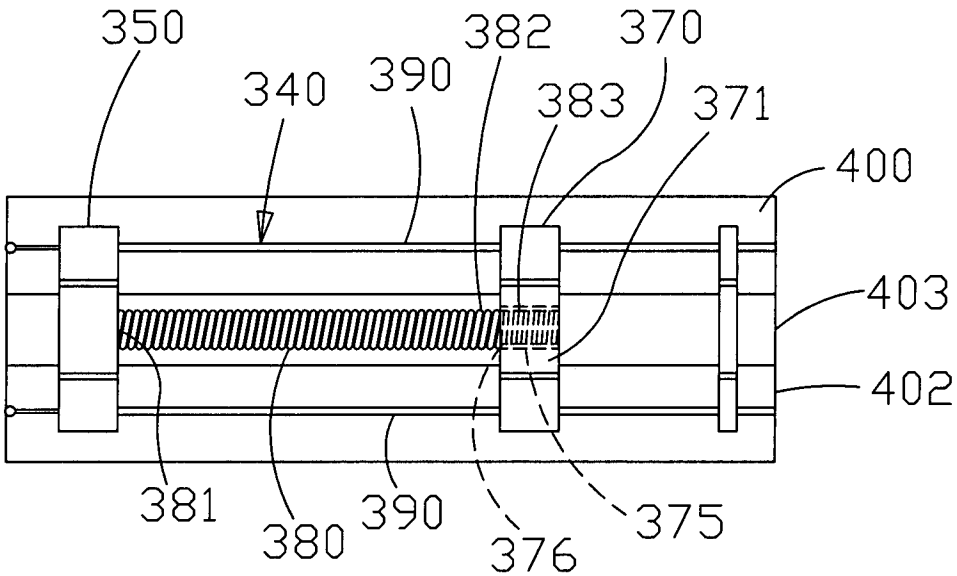
FIG. 21 is a side view of the alternative indexing assembly shown in FIG. 20, but with one tube removed to illustrate the indexer.
Figure 20:
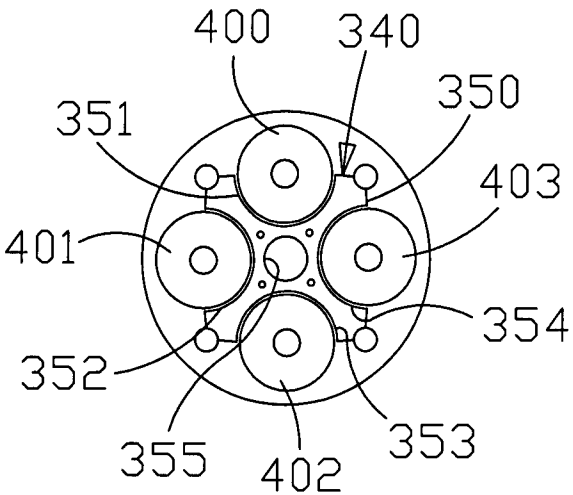
FIG. 20 is an end view of an alternative indexing assembly of the present invention.

Looking now to FIG. 18, it is seen that a preferred embodiment of an indexing assembly 110 is provided. The indexing assembly is comprised of a rotator 115, a first indexing plate 120 and a second indexing plate 160. The indexing assembly 110 indexes relative the mounting assembly 70, as provided below. The indexing assembly has a central or longitudinal axis that is generally parallel to the central axis of the mounting assembly 70.

Figure 3:
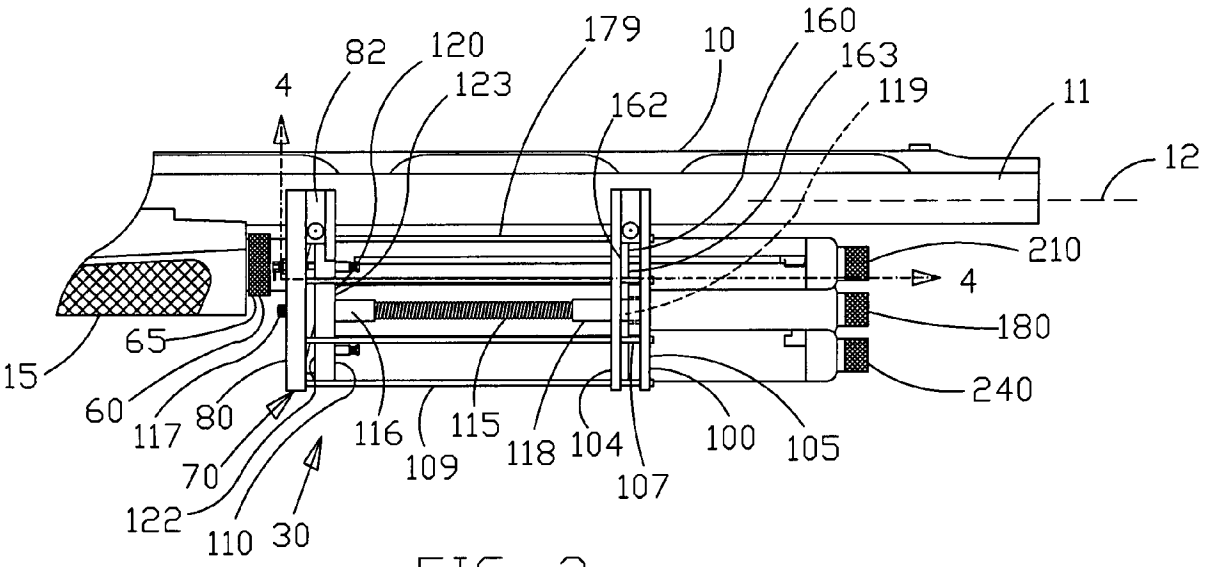
FIG. 3 is close up side view of the embodiment of the present invention shown in FIG. 1, but with one tube removed to illustrate the rotator.
Figure 4:
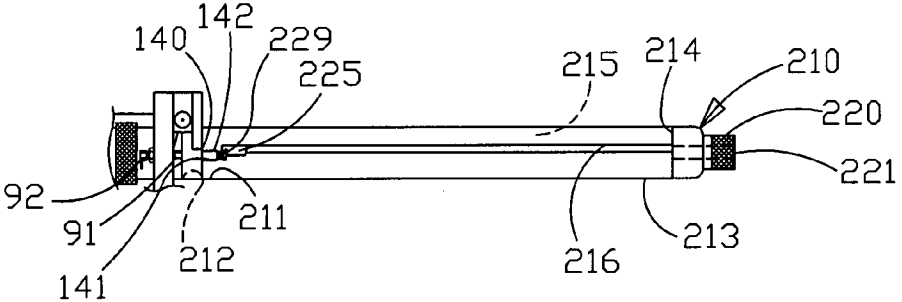
FIG. 4 is a cross-sectional view taken along line 4-4 in FIG. 3.
Figure 7:
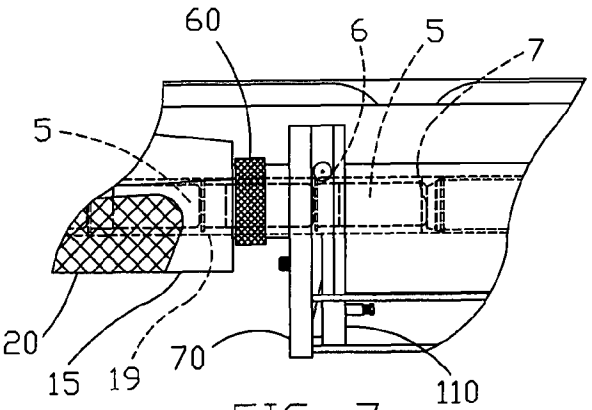
FIG. 7 is a partial side view showing spacing of shells as they pass through the adapter, first mounting plate and first indexing plate.
Figure 8:
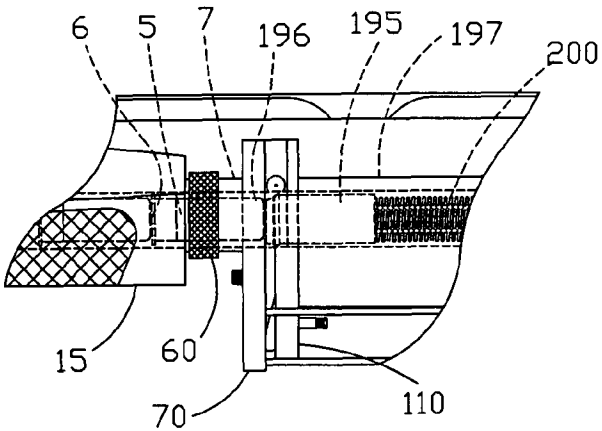
FIG. 8 is similar to FIG. 7, but shows a boss in the final tube advanced as the shells have been advanced one position.

Looking now to FIGS. 3 and 18, it is seen that a rotator 115 is illustrated. In the preferred embodiment, the rotator 115 comprises a spring. Yet, it is understood that other means for causing rotation, such as electric or magnetic rotators, can be utilized without departing from the broad aspects of the present invention. The spring 115 preferably has ends 116 and 118. A connector 117 is the first end 116, and a connector 119 is at the second end 118. The first connector 117 can be threaded and can mate with the central hole 86 in the first mounting plate 80. The second connector 119 can also be threaded, and connects to the second indexing plate 160.

Figure 15:
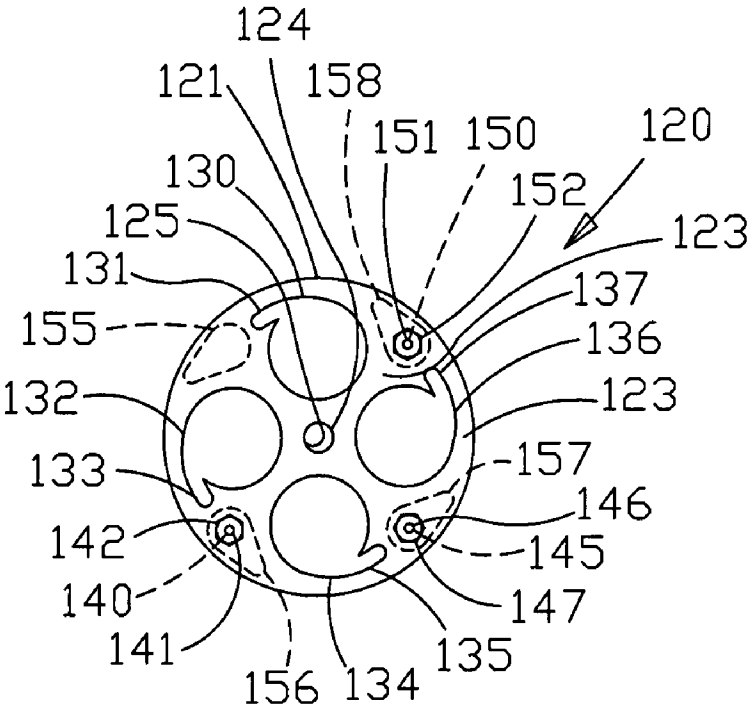
FIG. 15 is an isolation side view of one embodiment of the first indexing plate.

The first indexing plate 120 is best illustrated in FIGS. 15 and 18, and is illustrated in several other figures as well. The first indexing plate 120 has a generally circular perimeter 121, and has opposed sides 122 and 123. A central hole 124 centrally passes through the plate 120. Several bearings 125 can be provided for reducing friction between the plate 120 and the portion of the rotator 115 that passes through the hole 124.

A first tube hole 130 is provided. The tube hole 130 is preferably threaded to removably receive one of a plurality of tubes (described below). The hole 130 has a slot 131 to prevent obstructions between the plate 120 and the tips of cams (also described below). A second tube hole 132 is also provided. The tube hole 132 is preferably threaded to removably receive one of a plurality of tubes (described below). The hole 132 has a slot 133 to prevent obstructions between the plate 120 and the tips of cams (also described below). A third tube hole 134 is also provided. The tube hole 134 is preferably threaded to removably receive one of a plurality of tubes (described below). The hole 134 has a slot 135 to prevent obstructions between the plate 120 and the tips of cams (also described below). A fourth tube hole 136 is also provided. The tube hole 136 is preferably threaded to removably receive one of a plurality of tubes (described below). The hole 136 has a slot 137 to prevent obstructions between the plate 120 and the tips of cams (also described below).

Several release pin holes 140, 145 and 150 are also provided. Hole 140 is located adjacent slot 133, hole 145 is located adjacent slot 135 and hole 150 is located adjacent slot 137. Release pin 141 is operable within pin hole 140, and holder 142 biases the pin in a first direction such that the pin is retracted into the first indexing plate 120. Release pin 146 is operable within pin hole 145, and holder 147 biases the pin in a first direction such that the pin is retracted into the first indexing plate 120. Release pin 151 is operable within pin hole 150, and holder 152 biases the pin in a first direction such that the pin is retracted into the first indexing plate 120.

Several stops 155, 156, 157 and 158 are provided, as best illustrated in FIGS. 15 and 18. In the preferred embodiment, the stops are generally wedge shaped, having a ramp and a riser that is perpendicular with the central axis of the indexing assembly. In this regard, pin 91 can engage the riser to prevent the index assembly from indexing relative the mounting assembly. Release pin hole 140 passes through plate 120 adjacent the riser of stop 156. Release pin hole 145 passes through plate 120 adjacent the riser of stop 157. Release pin hole 150 passes through plate 120 adjacent the riser of stop 158.

Looking now again to FIGS. 16 and 18, it is seen that a second indexing plate 160 is illustrated. The second indexing plate 160 has a generally circular perimeter 161. The perimeter is preferably a solid perimeter 160 that is aligned with the bearings 107 between the first and second plates 104 and 105 of the second mount 100. The second indexing plate 160 further has a first side 162 and a second side 163, and a central hole 164. The central hole 164 is centrally aligned with central hole 124 of the first indexing plate 120. The central hole 164 can be connected to the connector 119 at the end 118 of the rotator 115. In this regard, the connection can be a threaded with threads 165 or have another type of connection.

A plurality of tube holes are provided. In this regard, tube hole 170 with slot 171 is provided, tube hole 172 with slot 173 is provided, tube hole 174 with slot 175 is provided, and tube hole 176 with slot 177 is provided. The tubes (described below) are supported by the interior perimeter of the tubes holes, and the cams of the respective bosses (described below) pass through the respective slots.

It is appreciated that the spring rotator is fixed rotationally to the first mount 80 and to the second indexing plate 160. In this regard, upon turning the indexing assembly in a first direction relative the mounting assembly, the rotator is placed under increasing amounts of tension. The indexing assembly is prevented from releasing the tension on the rotator because of engagement of the pin 91 and one of the stops 155, 156, 157 or 158. It is appreciated that an aligned release pin 141, 146 or 151 can cause the pin 91 to retract into the first mount 80 and allow the indexing assembly to index. As the release pin rotates away with the indexing assembly, the pin 91 is no longer constrained and again protrudes from the second side 85 of the first mount. The indexing assembly ceases indexing with the pin 91 engages the next successive stop, respectively. The spring rotator has a longitudinal axis that is generally parallel to the longitudinal axis of the barrel.

It is well understood that the rotator can be electronically or magnetically controlled without departing from the broad aspects of the present invention. In an embodiment where the present invention is used in place of a magazine, it is understood that an electronic rotator could be of advantage. In this regard, the user could select between different auxiliary tubes, and accordingly electronically toggle between loads of different strengths all the way between stun and lethal.

Figure 11:
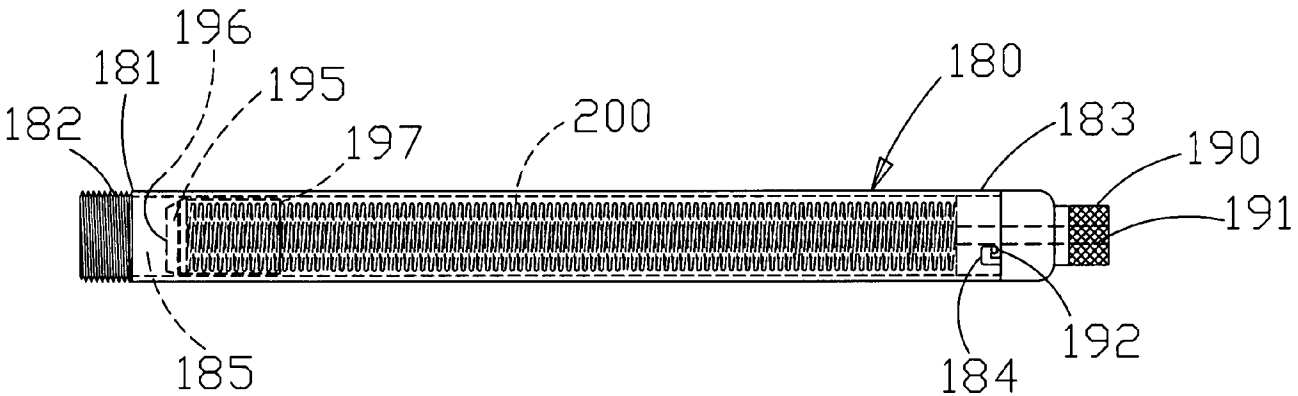
FIG. 11 is a top view of the main tube showing the boss without a projecting tip.
Figure 13:
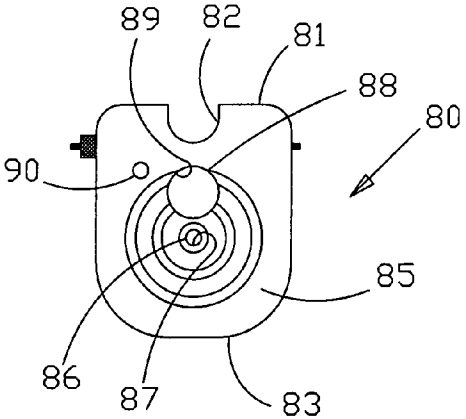
FIG. 13 is an isolation side view of one embodiment of the second side of the first mounting plate.
Figure 12:
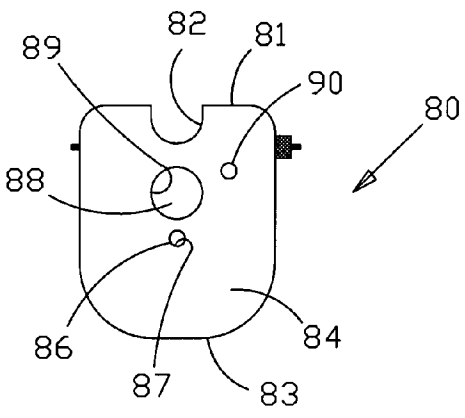
FIG. 12 is an isolation side view of one embodiment of the first side of the first mounting plate.

Looking now to FIG. 11, it is seen that a main tube 180 is illustrated. The tube 180 has a first end 181 that is threaded with threads 182 to be received within hole 130 in the first indexing plate 120. The tube 180 further has a second end 183 that can preferably be fitted with bayonet style connectors 184. The tube 180 has an interior 185. A cap 190 is provided, having a central hole 191 and bayonet style hooks 192. A boss 195 is further provided. The boss 195 has a first end 196 and an opposed second end 197. The boss interfaces with a shell within the tube 180 and advances the shell forward under pressure of a spring 200. A rod passes through the hole 191 and is used to prevent the spring 200 from bending when placing the cap 190 on the tube 180. During operation, the spring advances the boss through the tube 180 and all the way through an existing load tube magazine when the present invention is connected to the existing magazine tube. No indexing boss is required on the main tube, as tube 180 is the last tube to be emptied and no additional indexing is required.

Looking now particularly at FIGS. 4, 9A-E and 10, it is seen that a second load tube 210 is illustrated. The tube 210 has a first end 211 that is threaded with threads 212 to be received within hole 132 of the first indexing plate 120. The tube 210 further has a second end 213 that that can preferably be fitted with bayonet style connectors 214. The tube 210 has an interior 215. The tube 210 preferably has a slot 216 that longitudinally spans a majority of its length.

Figures 9A, 9B, 9C, 9D, 9E:
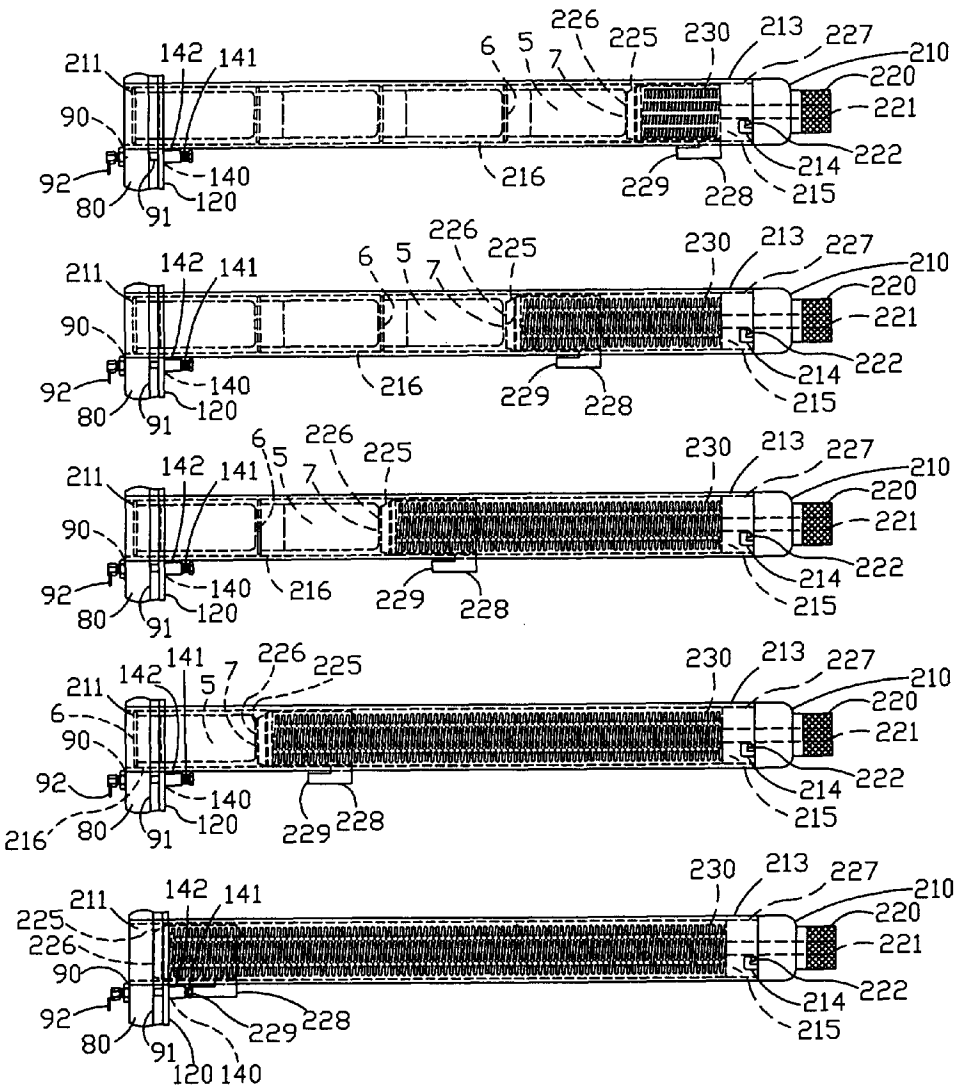
FIG. 9A is an isolation side view of a load tube showing four shells.
FIG. 9B is an isolation side view of a load tube showing three shells.
FIG. 9C is an isolation side view of a load tube showing two shells.
FIG. 9D is an isolation side view of a load tube showing one shell.
FIG. 9E is an isolation side view of a load tube with the last shell ejected and the tip of a preferred embodiment of the boss engaging the release pin of a preferred indexing plate to temporarily retract the pin of the mounting plate.
Figure 10:
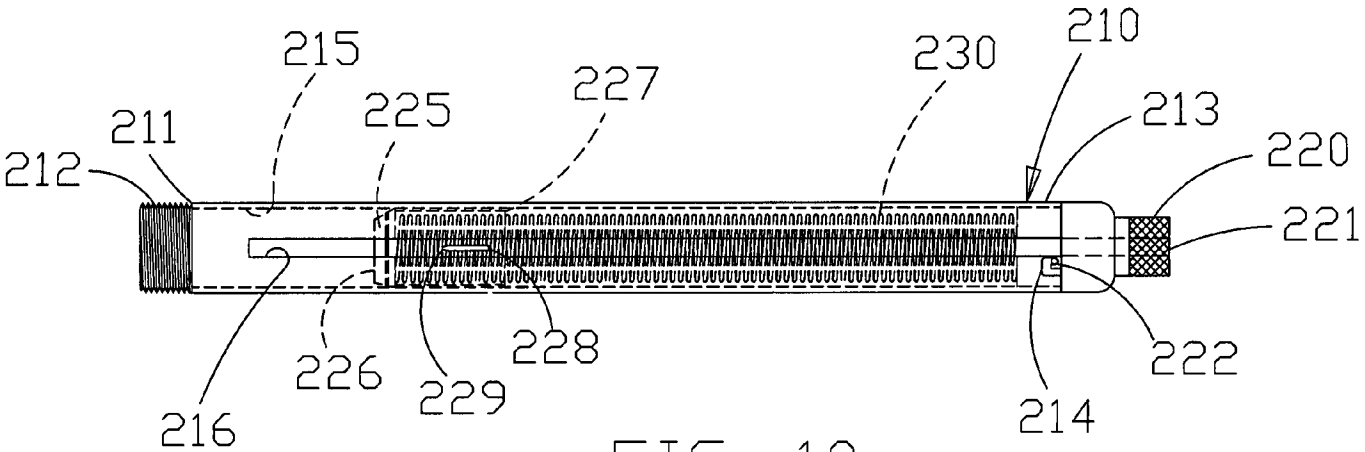
FIG. 10 is a top view of a tube showing the tip of a boss projecting through a slot of a tube.

A cap 220 is provided, having a central hole 221 and bayonet style hooks 222. A boss 225 is further provided. The boss 225 has a first end 226 and a second end 227. A cam 228 is on the perimeter of the boss and extends through the slot 216. The cam 228 has a tip 229 projecting forward on the outside of the tube 210. The tip 229 contacts pin 141 when the last shell is ejected from the tube 210, as shown in FIG. 9E. A spring 230 urges the boss forward and causes the tip 229 to overcome the bias in release pin 141. When release pin 141 is moved under operation of the tip 229, the release pin causes the pin 91 to temporarily retract into the first mounting plate to allow the indexing assembly to rotate and align the next tube 180 with the alignment hole.

While not shown in detail, tubes 240 and 250 are identical to tube 210. In this regard, tube 240 has ends 241 and 242, and tube 250 has ends 251 and 252. Each tube's respective first end is threaded with threads to be received within the respective hole of the first indexing plate 120. The second ends of the tubes are preferably fitted with bayonet style connectors. The tubes have an interior. The tubes preferably have a slot that longitudinally spans a majority of their length. Caps are provided, each having a central hole and bayonet style hooks. Bosses are further provided. Each boss has a first end and a second end. A cam is on the perimeter of each boss. The cams have a tip projecting forward on the exterior of their respective tubes. The tips contact a release pin when the last shell is ejected from each respective tube. A spring within urges the boss forward and causes the tip to overcome the bias in release pin. When release pin is moved under operation of the tip, the release pin causes the pin to retract into the first mounting plate to allow the indexing assembly to rotate and align the next tube with the alignment hole.

Latch 92 can be used to hold pin 91 in a retracted position thereby enabling all of the tension in the rotator to be released.

It is appreciated that the present invention is always in position to be loaded or reloaded. For example, if each tube has capacity for four shells and 7 shots are fired. Tube 250 would be empty and tube 240 would have 1 shell remaining. To reload to invention to maximum capacity, three shells could be added to tube 240, the indexing assembly would be manually rotated to align tube 250 with the alignment hole 88 and four more shells would be added to fill the present invention to maximum capacity.

Looking now to FIGS. 19-24, it is seen that an alternative embodiment 300 of the present invention is illustrated. In this embodiment 300, a mounting assembly and an indexing assembly are provided. The majority of the components are similar in function to the embodiment described above, and for the sake of brevity, those components are not re-illustrated herein.

The mounting assembly has a first mounting plate (not shown), a first clamp 310 and a second clamp 311. A housing 320 is also provided. The mounting plate is similar to the one described above.

A modified frame 340 is used in the indexing assembly. The frame 340 has a first piece 350 with sections 351, 352, 353 and 354. A central hole 355 is provided for allowing the rotator 380 to pass. A second piece 370 with sections 371 and a central hole 375 is also provided. The sections in the first piece 350 and the second piece 370 hold tubes 400, 401, 402 and 403, respectively, in place. The tubes can rotate within the interior of the housing 320.

One preferred rotator 380 is a spring, having ends 381 and 382. A connector 383 can be connected to end 382 of the spring to fix the rotationally fix the rotator to the second piece 370, in a manner similar to the embodiment illustrated above.

Several longitudinal supports 390 are provided between the pieces 350 and 370 of the frame 340 of the indexing assembly.

Figure 22:
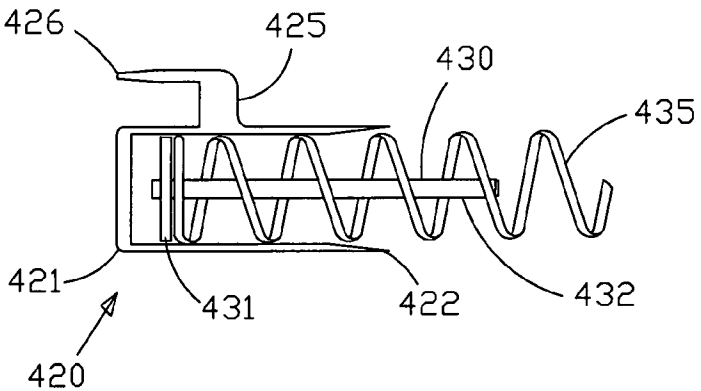
FIG. 22 is an isolation side view of an alternative boss.
Figure 23:
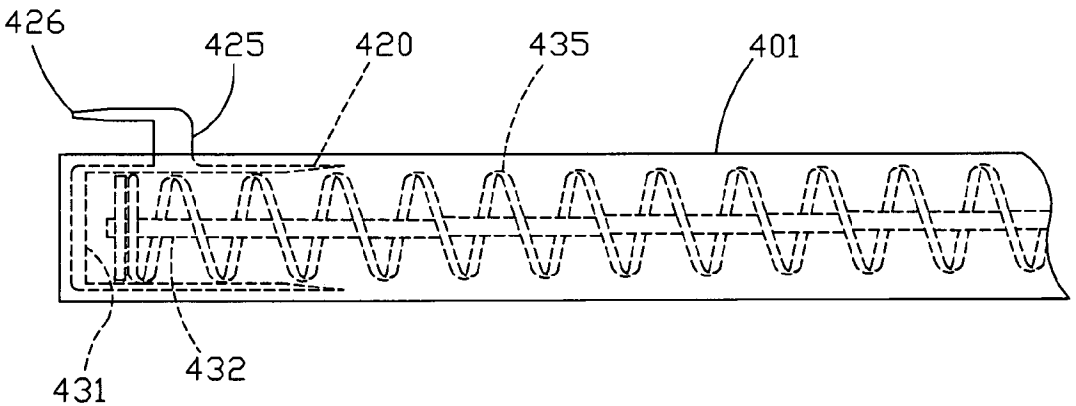
FIG. 23 is a side view showing the boss within a load tube.

Looking now to FIGS. 22 and 23, an alternative boss 420 is illustrated. The boss 420 has ends 421 and 422. A cam 425 extends from the sidewall of the boss and can pass through a slot (not shown) to the exterior of the tube. The cam 425 had an elongated tip 426 that projects preferably to approximately end 421 of the boss 420. A plunger 430 is shown, having a flange 431 and a rod 432. A spring 435 is also shown and is used to provide an advancing force to the boss 420.

Figure 24:
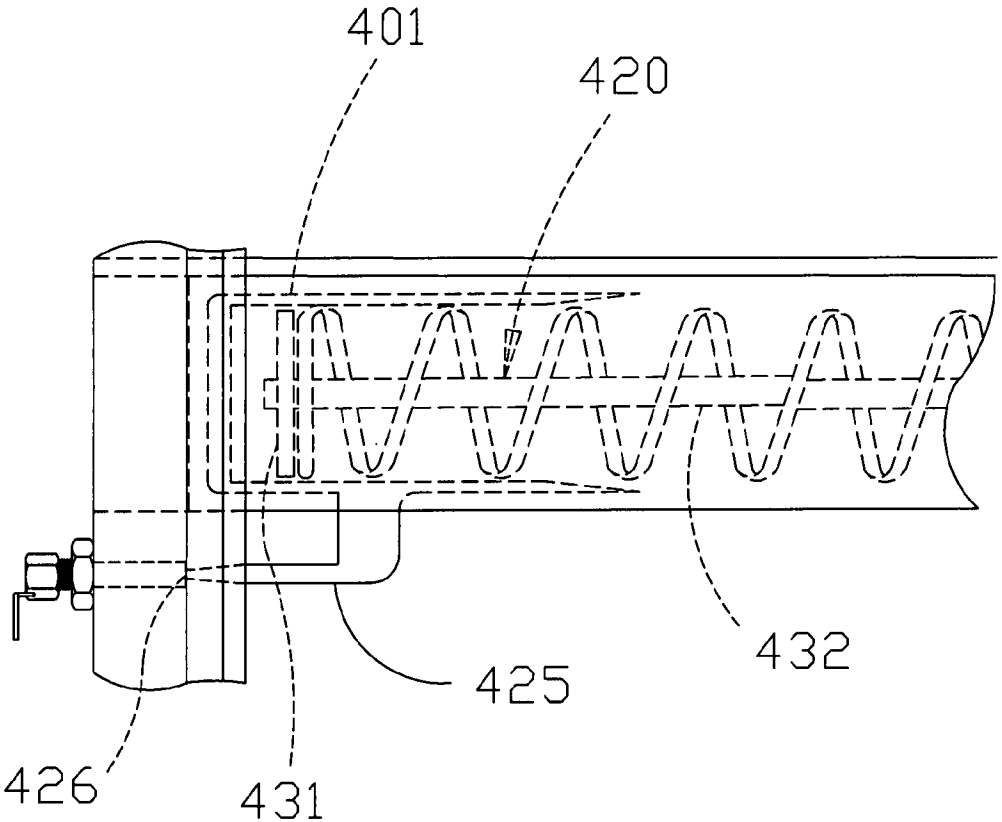
FIG. 24 is a close up side view showing the tip of the alternative boss directly engaging the pin to temporarily retract the pin.

Turning now to FIG. 24, it is seen how the tip 426 of the cam 425 of the boss 420 directly engages the pin 91 as the boss 420 reaches the end of its respective tube, and causes the pin 91 to retract into the first mounting plate and disengage from the stop. When the stop and pin are disengaged, the indexing assembly indexes until the pin engages the next stop.

Thus it is apparent that there has been provided, in accordance with the invention, an auto loader firearm accessory that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An attachment for a firearm having a barrel with a barrel longitudinal axis, said attachment comprising:

a mounting assembly having a first mount with a first mount first side and a first mount second side, said first mount having a pin biased to project from said first mount second side in a direction generally parallel to the barrel longitudinal axis;

an indexing assembly having a first indexing plate with a first indexing plate first side and a first indexing plate second side, and a plurality of stops projecting from said first indexing plate first side, said indexing assembly further having a rotator, wherein said indexing assembly is aligned with respect to mounting assembly by engagement of said pin and one of said plurality of stops;

a first tube; and a second tube, said second tube having a boss within said second tube, wherein when said second tube is emptied, said boss causes said pin to temporarily retract from said first mount second side to thereby enable said rotator to rotate said indexing assembly until said pin engages the next of said plurality of stops.

2. The attachment of claim 1 wherein said mounting assembly further comprises a second mounting plate spaced from said first mounting plate, wherein said indexing assembly rotates within said second mounting plate.

3. The attachment of claim 1 wherein:

said indexing assembly has a second indexing plate; and said rotator is a spring with a longitudinal axis generally parallel to said barrel longitudinal axis, said spring being fixed to said first mounting plate and to said second indexing plate, whereby rotation of said indexing assembly relative mounting assembly in a first direction results in increased spring tension, and rotation of said indexing assembly relative mounting assembly in the opposite direction results in decreased spring tension.

4. The attachment of claim 1 further comprising:

a third tube having a second boss within said third tube, wherein when said third tube is emptied, said second boss causes said pin to temporarily retract from said first mount second side to thereby enable said rotator to rotate said indexing assembly until said pin engages the next of said plurality of stops; and a fourth tube having a third boss within said fourth tube, wherein when said fourth tube is emptied, said third boss causes said pin to temporarily retract from said first mount second side to thereby enable said rotator to rotate said indexing assembly until said pin engages the next of said plurality of stops.

5. The attachment of claim 1 wherein said plurality of stops is a plurality of wedge shaped stops.

6. The attachment of claim 1 wherein said first indexing plate has a release pin operable from said first indexing plate second side that is selectably extendable from said first indexing plate first side under operation said boss to reposition said pin to cease engagement of said pin and one of said plurality of stops.

7. The attachment of claim 1 wherein said boss has a tip that extends through said first indexing plate to directly reposition said pin to cease engagement of said pin and one of said plurality of stops.

8. The attachment of claim 1 further comprising an adapter, wherein said adapter has an adjustable length to provide proper spacing of successive load cartridges within said attachment to allow said indexing assembly to rotate within said mounting assembly.

9. The attachment of claim 8 wherein said adapter has a first end that connects directly to the end of a magazine tube and a second end that connects directly to said mounting assembly.

10. The attachment of claim 1 wherein said mounting assembly further comprises a housing.

11. The attachment of claim 1, wherein the first mount further comprises an alignment hole, the indexing assembly selectably aligns one of the plurality of tubes with said alignment hole, and further comprising an adapter having an adapter first end and an adapter second end, said adapter first end being removably connectable to the firearm and said adapter second end being removably connectable to said mounting assembly, wherein: there is a path between said one of said plurality of tubes in alignment with said alignment hole and through said alignment hole of said first mount and further through said adapter and into the firearm, and said adapter has an adjustable length such that the ends of two adjacent objects contained within said one of said plurality of tubes is located at the interface between said alignment hole and said indexing assembly during the loading sequence, whereby said indexing assembly can index relative said mounting assembly.

12. The attachment of claim 11 wherein: said boss has a tip external of said one of said plurality of tubes that causes said pin to retract.

13. The attachment of claim 12 wherein said tip directly engages said pin to force said pin to retract.

14. The attachment of claim 11 wherein:

the firearm has a magazine tube with an end; and said adapter connects directly to said end of said magazine tube.

* * * * *